US010094092B2

(12) United States Patent
Joung et al.

(10) Patent No.: US 10,094,092 B2
(45) Date of Patent: Oct. 9, 2018

(54) HYDRAULIC CIRCUIT FOR CONSTRUCTION MACHINERY HAVING FLOATING FUNCTION AND METHOD FOR CONTROLLING FLOATING FUNCTION

(71) Applicant: VOLVO CONSTRUCTION EQUIPMENT AB, Eskilstuna (SE)

(72) Inventors: Hea-Gyoon Joung, Busan (KR); Sung-Gon Kim, Changwon-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 198 days.

(21) Appl. No.: 14/900,495

(22) PCT Filed: Oct. 31, 2013

(86) PCT No.: PCT/KR2013/009788
§ 371 (c)(1),
(2) Date: Dec. 21, 2015

(87) PCT Pub. No.: WO2014/208828
PCT Pub. Date: Dec. 31, 2014

(65) Prior Publication Data

US 2016/0333551 A1 Nov. 17, 2016

(30) Foreign Application Priority Data

Jun. 28, 2013 (WO) ..... PCT/KR2013/005742

(51) Int. Cl.
*F15B 13/02* (2006.01)
*E02F 9/22* (2006.01)
(Continued)

(52) U.S. Cl.
CPC ..... *E02F 9/2207* (2013.01); *E02F 9/2228* (2013.01); *E02F 9/2242* (2013.01);
(Continued)

(58) Field of Classification Search
CPC ..... F15B 11/17; F15B 13/021; F15B 21/14; F15B 2211/30127; F15B 2211/31582; F15B 2211/88; E02F 9/2242; E02F 9/2292
See application file for complete search history.

(56) References Cited

U.S. PATENT DOCUMENTS 3,978,998 A * 9/1976 Klitz ..... E02F 9/123 414/687
4,207,740 A * 6/1980 Ripa ..... E02F 3/42 137/596.13
(Continued)

FOREIGN PATENT DOCUMENTS

JP H06128983 A 5/1994
JP 2010084333 A 4/2010
(Continued)

OTHER PUBLICATIONS

International Search Report (in English and Korean) and Written Opinion of the International Searching Authority (in Korean) for PCT/KR2013/009788, dated Mar. 20, 2014; ISA/KR.
(Continued)

*Primary Examiner* — F. Daniel Lopez
*Assistant Examiner* — Matthew Wiblin
(74) *Attorney, Agent, or Firm* — Harness, Dickey & Pierce, P.L.C.

(57) ABSTRACT

A hydraulic circuit for construction machinery having a floating function, according to the present invention, is provided with: two or more hydraulic pumps; a hydraulic cylinder connected to the hydraulic pumps; a boom driving control valve provided on the flow path between the hydraulic pump on one side and the hydraulic cylinder; a boom confluence control valve provided on the flow path between the hydraulic pump on the other side and the hydraulic cylinder; an operating lever; a first sensor for measuring the
(Continued)

hydraulic fluid pressure of a large chamber of the hydraulic cylinder; a second sensor for measuring the boom lowering pilot pressure applied to one end of the boom driving control valve; a control valve provided on the flow path between the operating lever and the other ends of the boom driving control valve and the boom confluence control valve.

6 Claims, 5 Drawing Sheets

(51) Int. Cl.
*F15B 11/17* (2006.01)
*F15B 11/10* (2006.01)

(52) U.S. Cl.
CPC ..... *E02F 9/2282* (2013.01); *E02F 9/2285* (2013.01); *E02F 9/2292* (2013.01); *F15B 11/10* (2013.01); *F15B 11/17* (2013.01); *F15B 13/021* (2013.01); *F15B 2211/20576* (2013.01); *F15B 2211/30565* (2013.01); *F15B 2211/3127* (2013.01); *F15B 2211/31582* (2013.01); *F15B 2211/6313* (2013.01); *F15B 2211/6316* (2013.01); *F15B 2211/665* (2013.01)

(56) References Cited

U.S. PATENT DOCUMENTS 4,367,624 A * 1/1983 Ogata ..... E02F 3/844 60/484
4,476,679 A * 10/1984 Sato ..... E02F 9/2217 60/429
5,890,303 A 4/1999 Ishikawa et al.
6,186,044 B1 2/2001 Hajek, Jr. et al.
6,892,535 B2 * 5/2005 Kim ..... E02F 9/2203 60/429
7,490,421 B1 * 2/2009 Pletzer ..... E02F 3/437 172/10
8,818,651 B2 8/2014 Joung et al.
9,103,355 B2 8/2015 Ku et al.
9,194,382 B2 11/2015 Shin et al.
9,790,665 B2 * 10/2017 Tajima ..... E02F 9/2296
2003/0121184 A1 * 7/2003 Yoshino ..... E02F 9/2203 37/348
2007/0056277 A1 3/2007 Mizoguchi et al.
2011/0318157 A1 12/2011 Okamura et al.
2012/0315119 A1 * 12/2012 Magaki ..... B60W 20/00 414/685
2013/0121852 A1 5/2013 Joung et al.
2014/0010688 A1 1/2014 Kim
2014/0238010 A1 8/2014 Joung et al.
2014/0325975 A1 11/2014 Kim et al.

FOREIGN PATENT DOCUMENTS

JP 2011-236562 A 11/2011
KR 100621977 B1 9/2006

OTHER PUBLICATIONS

Extended European Search Report issued by the European Patent Office (EPO) dated Jan. 25, 2017 regarding EP Patent Application No. 13888326.9 (9 pages).

* cited by examiner

HYDRAULIC CIRCUIT FOR CONSTRUCTION MACHINERY HAVING FLOATING FUNCTION AND METHOD FOR CONTROLLING FLOATING FUNCTION

CROSS-REFERENCE TO RELATED APPLICATION

This application is a 371 U.S. National Stage of International Application No. PCT/KR2013/009788, filed on Oct. 31, 2013 and claims priority to International Application No. PCT/KR2013/005742, filed Jun. 28, 2013. The entire disclosures of the above applications are incorporated herein by reference.

TECHNICAL FIELD

The present invention relates to a hydraulic circuit for a construction machine having a floating function and a method for controlling a floating function. More particularly, the present invention relates to such a hydraulic circuit for a construction machine having a floating function and a method for controlling a floating function, in which in the case where the leveling and grading work is performed by using an excavator or a boom descends by its own weight, hydraulic fluid discharged from a hydraulic pump can be used for a hydraulic actuator other than a boom cylinder, thereby saving the hydraulic energy.

BACKGROUND OF THE INVENTION

A hydraulic circuit for a construction machine having a floating function in accordance with the prior art is disclosed in Korean Patent Registration No. 10-0621977. As shown in FIG. 1, the hydraulic circuit for a construction machine having a floating function includes:

at least two hydraulic pumps 1 and 2;

a hydraulic cylinder 3 that is driven by hydraulic fluids supplied from the hydraulic pumps 1 and 2;

a boom driving control valve 4 that is installed in a flow path between any one 1 of the hydraulic pumps 1 and 2 and the hydraulic cylinder 3 and is configured to be shifted to control a start, a stop, and a direction change of the hydraulic cylinder 3;

a boom confluence control valve 5 that is installed in a flow path between the other 2 of the hydraulic pumps 1 and 2 and the hydraulic cylinder 3 and is configured to be shifted to allow the hydraulic fluid discharged from the hydraulic pump 2 to join the hydraulic fluid that has passed through the boom driving control valve 4 to cause the joined hydraulic fluids to be supplied to a large chamber of the hydraulic cylinder 3, or to allow hydraulic fluids of the large chamber and a small chamber of the hydraulic cylinder 3 to join together so as to be supplied to a hydraulic tank 6 to shift the boom confluence control valve 5 to a floating state; and a control valve 7 that is installed in a flow path between a manipulation lever (not shown), and the boom driving control valve 4 and the boom confluence control valve 5, and configured to be shifted to supply the hydraulic fluid discharged from the hydraulic pump 1 to the small chamber of the hydraulic cylinder 3 through application of the boom-down pilot pressure to the boom driving control valve 4, or to shift the boom confluence control valve 5 to an on state to cause the boom confluence control valve 5 be shifted to the floating state through application of the boom-down pilot pressure to the boom confluence control valve 5.

When a spool of the control valve 7 is shifted to the left on the drawing sheet in response to an electrical signal applied thereto, a boom-down pilot pressure is applied to one end of the boom confluence control valve 5 via the control valve 7 by the manipulation of the manipulation lever to cause a spool of the boom confluence control valve 5 to be shifted to the left on the drawing sheet.

In other words, the boom confluence control valve 5 is shifted to the floating state. The boom confluence control valve 5 is shifted to allow the hydraulic fluids of the large chamber and the small chamber of the hydraulic cylinder 3 to join together in the boom confluence control valve 5 so as to be returned to the hydraulic fluid tank 6 so that the boom confluence control valve 5 is shifted to the floating state.

As described above, when the boom confluence control valve 5 is shifted to the floating state by the shift of the control valve 7, the boom-down pilot pressure is not applied to the boom driving control valve 4, and thus the hydraulic fluid from the hydraulic pump 1 is not supplied to the small chamber of the hydraulic cylinder 3. As a result, the boom cannot descend in a state where the control valve 7 is switched to the on state, thus making it impossible to perform the jack-up operation.

SUMMARY OF THE INVENTION

Accordingly, the present invention has been made to solve the aforementioned problems occurring in the prior art, and it is an object of the present invention to provide a hydraulic circuit for a construction machine having a floating function and a method for controlling a floating function, in which the floating function can be inactivated during the boom-up or jack-up operation, and the floating function can be activated during the boom-down operation.

Technical Solution

To achieve the above object, in accordance with an embodiment of the present invention, there is provided a hydraulic circuit for a construction machine having a floating function, including:

at least two hydraulic pumps;

a hydraulic cylinder driven by hydraulic fluids supplied from the hydraulic pumps;

a boom driving control valve installed in a flow path between any one of the hydraulic pumps and the hydraulic cylinder and configured to be shifted to control a start, a stop, and a direction change of the hydraulic cylinder;

a boom confluence control valve installed in a flow path between the other of the hydraulic pumps and the hydraulic cylinder and configured to be shifted to allow the hydraulic fluids discharged from the hydraulic pumps to join together so as to be supplied to a large chamber of the hydraulic cylinder or to allow hydraulic fluids of the large chamber and a small chamber of the hydraulic cylinder to join together so as to be supplied to a hydraulic tank;

a manipulation lever configured to output a manipulation signal corresponding to a manipulation amount;

a first pressure sensor configured to measure a pressure of the hydraulic fluid on the large chamber of the hydraulic cylinder 3;

a second pressure sensor configured to measure a boom-down pilot pressure that is applied to the other end of the boom driving control valve;

a control valve installed in a flow path between the manipulation lever, and the boom driving control valve and the boom confluence control valve, and configured to be shifted in response to the application of electrical signals that correspond to the pressure values detected by the first and second pressure sensors to shift the boom confluence control valve to a floating state through application of the boom-down pilot pressure to the boom confluence control valve, or to supply the hydraulic fluid of the one of the hydraulic pumps to the small chamber of the hydraulic cylinder by the shift of the boom driving control valve through application of the boom-down pilot pressure to the boom driving control valve.

To achieve the above object, in accordance with an embodiment of the present invention, there is provided a method for controlling a floating function for a construction machine including at least two hydraulic pumps, a hydraulic cylinder driven by hydraulic fluids supplied from the hydraulic pumps, a boom driving control valve installed in a flow path between any one of the hydraulic pumps and the hydraulic cylinder, a boom confluence control valve installed in a flow path between the other of the hydraulic pumps and the hydraulic cylinder, a manipulation lever, a first pressure sensor configured to measure a pressure of the hydraulic fluid on a large chamber of the hydraulic cylinder, a second pressure sensor configured to measure a boom-down pilot pressure that is applied to the other end of the boom driving control valve, and a control valve installed in a flow path between the manipulation lever, and the boom driving control valve and the boom confluence control valve, the method including:

a step of determining whether a boom floating function switch is operated to be turned on;

a step of, if the boom floating function switch is operated to be turned on, shifting the control valve to an on state in response to the application of an electrical signal to the control valve to cause the boom confluence control valve to be shifted to a floating state through application of the boom-down pilot pressure to the boom confluence control valve;

a step of measuring the hydraulic fluid pressure of the large chamber of the hydraulic cylinder through the first pressure sensor, and measuring the boom-down pilot pressure that is applied to the other end of the boom driving control valve through the second pressure sensor; and a step of shifting the control valve to an off state if the boom-down pilot pressure is higher than or equal to a predetermined pressure based on a detection signal of the second pressure sensor, and the hydraulic fluid pressure of the large chamber of the hydraulic cylinder is lower than or equal to a predetermined pressure based on a detection signal of the first pressure sensor.

In accordance with a preferred embodiment of the present invention, the control valve may be a solenoid valve configured to be shifted to an initial state where the hydraulic fluid of the one of the hydraulic pumps is supplied to the small chamber of the hydraulic cylinder through the application of the boom-down pilot pressure to the boom driving control valve, or to an on state where the boom confluence control valve is shifted to the floating state through the application of the boom-down pilot pressure to the boom confluence control valve.

Further, in accordance with a preferred embodiment of the present invention, the control valve may be shifted to an off state if the boom-down pilot pressure is higher than or equal to a predetermined pressure based on a detection signal of the second pressure sensor, and the hydraulic fluid pressure of the large chamber of the hydraulic cylinder is lower than or equal to a predetermined pressure based on a detection signal of the first pressure sensor.

To achieve the above object, in accordance with another embodiment of the present invention, there is provided a hydraulic circuit for a construction machine having a floating function, including:

at least two hydraulic pumps;

a hydraulic cylinder driven by hydraulic fluids supplied from the hydraulic pumps;

a boom driving control valve installed in a flow path between any one of the hydraulic pumps and the hydraulic cylinder and configured to be shifted to control a start, a stop, and a direction change of the hydraulic cylinder;

a boom confluence control valve installed in a flow path between the other of the hydraulic pumps and the hydraulic cylinder and configured to be shifted to allow the hydraulic fluids discharged from the hydraulic pumps to join together so as to be supplied to a large chamber of the hydraulic cylinder or to allow hydraulic fluids of the large chamber and a small chamber of the hydraulic cylinder to join together so as to be supplied to a hydraulic tank;

a manipulation lever configured to output a manipulation signal corresponding to a manipulation amount;

a first pressure sensor configured to measure a pressure of the hydraulic fluid on the large chamber of the hydraulic cylinder;

a second pressure sensor configured to measure a boom-down pilot pressure that is applied to the other end of the boom driving control valve;

a first electronic proportional control valve installed in a flow path between the manipulation lever and the boom confluence control valve and configured to shift the boom confluence control valve to a floating mode by generating the boom-down pilot pressure in proportion to an electrical signal applied thereto and applying the generated boom-down pilot pressure to the boom confluence control valve;

a second electronic proportional control valve installed in a flow path between the manipulation lever and the boom driving control valve and configured to supply the hydraulic fluid of the one of the hydraulic pumps to the small chamber of the hydraulic cylinder by generating the boom-down pilot pressure in proportion to the electrical signal applied thereto and applying the generated boom-down pilot pressure to the boom driving control valve; and a controller configured to receive an input of the pressure values detected by the first and second pressure sensors, calculate the electrical signal corresponding to the pressure value detected by the second pressure sensor, and apply the calculated electrical signal to the first and second electronic proportional control valves.

To achieve the above object, in accordance with another embodiment of the present invention, there is provided a method for controlling a floating function for a construction machine including at least two hydraulic pumps, a hydraulic cylinder driven by hydraulic fluids supplied from the hydraulic pumps, a boom driving control valve installed in a flow path between any one of the hydraulic pumps and the hydraulic cylinder, a boom confluence control valve installed in a flow path between the other of the hydraulic pumps and the hydraulic cylinder, a manipulation lever, a first pressure sensor configured to measure a pressure of the hydraulic fluid on a large chamber of the hydraulic cylinder, a second pressure sensor configured to measure a boom-down pilot pressure that is applied to the other end of the boom driving control valve, a first electronic proportional control valve installed in a flow path between the manipulation lever and the boom confluence control valve, and a second electronic proportional control valve installed in a flow path between the manipulation lever and the boom driving control valve, the method including:

a step of determining whether a boom floating function switch is operated to be turned on;

a step of measuring the hydraulic fluid pressure of the large chamber of the hydraulic cylinder through the first pressure sensor, and measuring the boom-down pilot pressure that is applied to the boom driving control valve through the second pressure sensor;

a step of supplying the hydraulic fluid of the one of the hydraulic pumps to a small chamber of the hydraulic cylinder by applying the boom-down pilot pressure, which is generated in proportion to an electrical signal corresponding to a pressure detection value of the second pressure sensor, to the boom driving control valve if the boom-down pilot pressure is higher than a predetermined pressure based on a detection signal of the second pressure sensor, and the hydraulic fluid pressure of the large chamber of the hydraulic cylinder is lower than a predetermined pressure based on a detection signal of the first pressure sensor; and a step of shifting the boom confluence control valve to a floating mode by applying the boom-down pilot pressure, which is generated in proportion to the electrical signal corresponding to the pressure detection value of the second pressure sensor, to the boom confluence control valve if the boom-down pilot pressure is lower than the predetermined pressure based on the detection signal of the second pressure sensor, and the hydraulic fluid pressure of the large chamber of the hydraulic cylinder is higher than the predetermined pressure based on the detection signal of the first pressure sensor.

Advantageous Effect

The hydraulic circuit for a construction machine having a floating function and the method for controlling the floating function in accordance with the present invention as constructed above have the following advantages.

In the case where the leveling and grading work is performed by using an excavator or the boom descends by its own weight, the hydraulic fluid discharged from the hydraulic pump is supplied to a hydraulic actuator other than a boom cylinder, thereby saving the hydraulic energy. In addition, in the floating mode, the hydraulic fluid discharged from the hydraulic pump is selectively supplied to a small chamber of the boom cylinder to perform the jack-up operation, thereby improving the workability.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
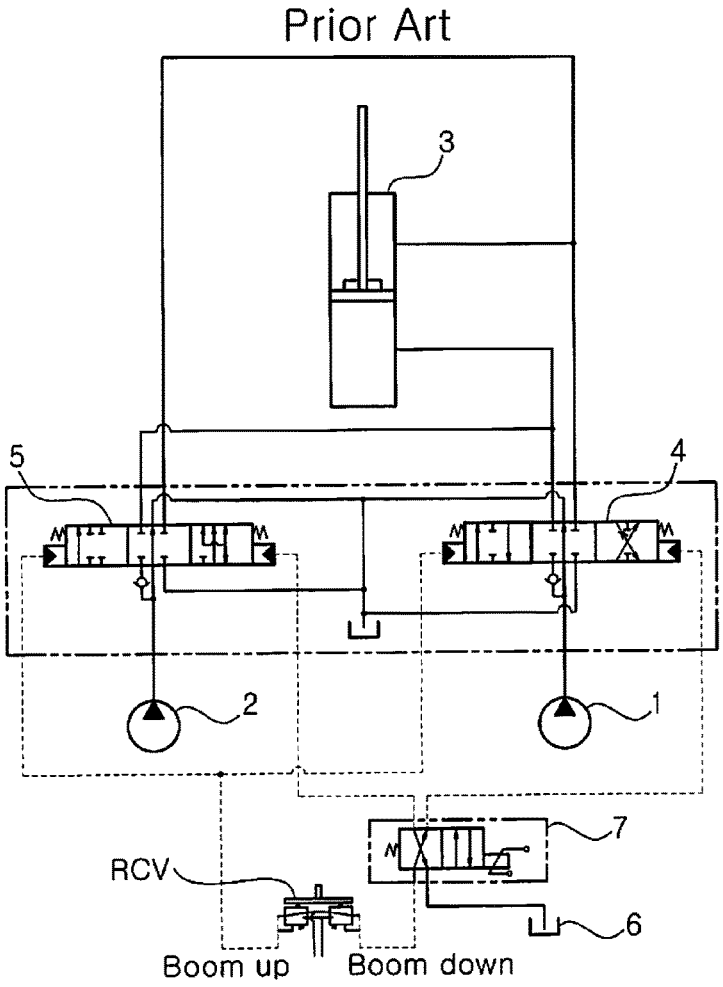
FIG. 1 is a diagram showing a hydraulic circuit for a construction machine having a floating function in accordance with the prior art.

1, 2: hydraulic pump
3: hydraulic cylinder
4: boom driving control valve
5: boom confluence control valve]
6: hydraulic fluid tank
7: control valve
8: first pressure sensor
9: second pressure sensor
11: controller

DETAILED DESCRIPTION OF THE INVENTION

Hereinafter, a hydraulic circuit for a construction machine having a floating function and a method for controlling a floating function for a construction machine in accordance with a preferred embodiment of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

In order to definitely describe the present invention, a portion having no relevant to the description will be omitted, and through the specification, like elements are designated by like reference numerals.

In the specification and the claims, when a portion includes an element, it is meant to include other elements, but not exclude the other elements unless otherwise specifically stated herein.

Prior to the following detailed description, the terms or words used in the specification and the claims of the present invention should not be construed as being typical or dictionary meanings, but should be construed as meanings and concepts conforming to the technical spirit of the present invention on the basis of the principle that an inventor can properly define the concepts of the terms in order to describe his or her invention in the best way.

Hereinafter, a hydraulic circuit for a construction machine having a floating function in accordance with a preferred embodiment of the present invention will be described in detail with reference to the accompanying drawings.

Figure 2:
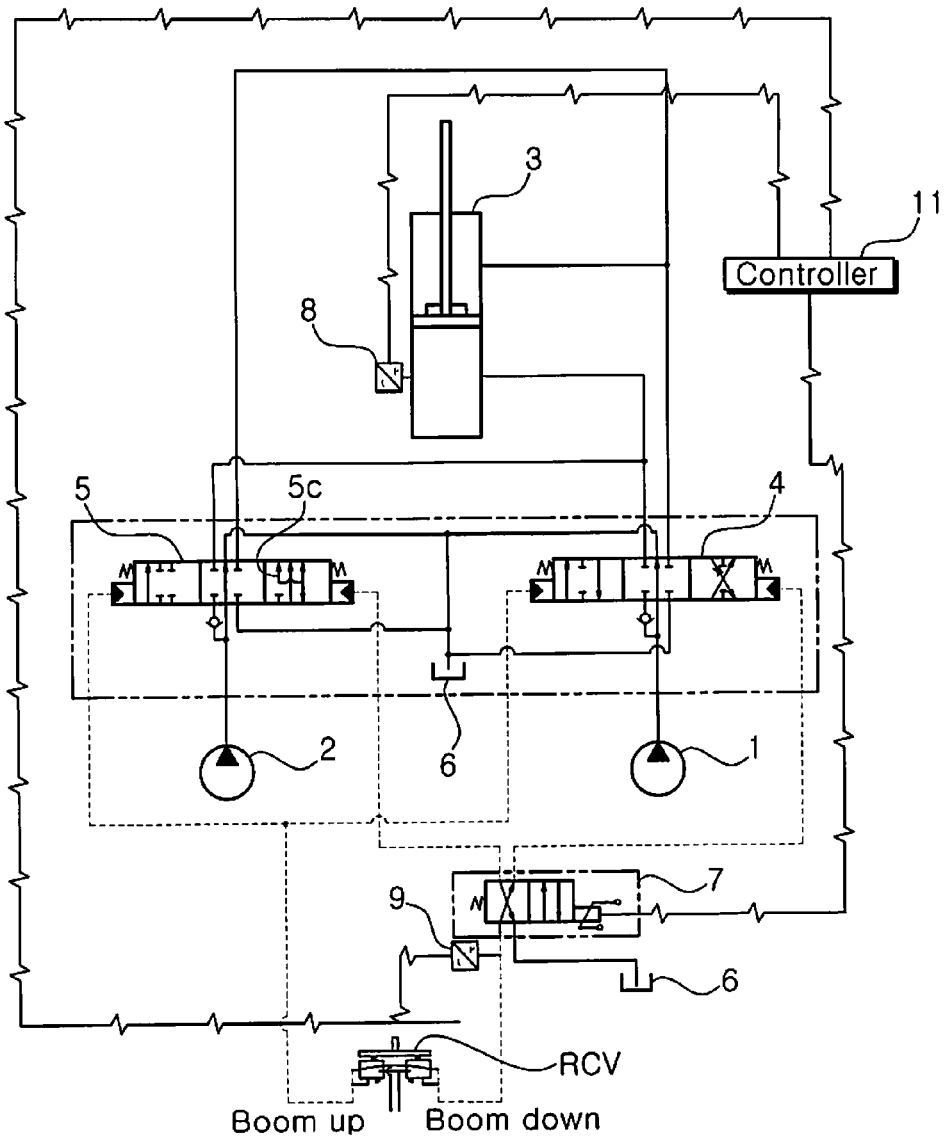
FIG. 2 is a diagram showing a hydraulic circuit for a construction machine having a floating function in accordance with an embodiment of the present invention.
Figure 3:
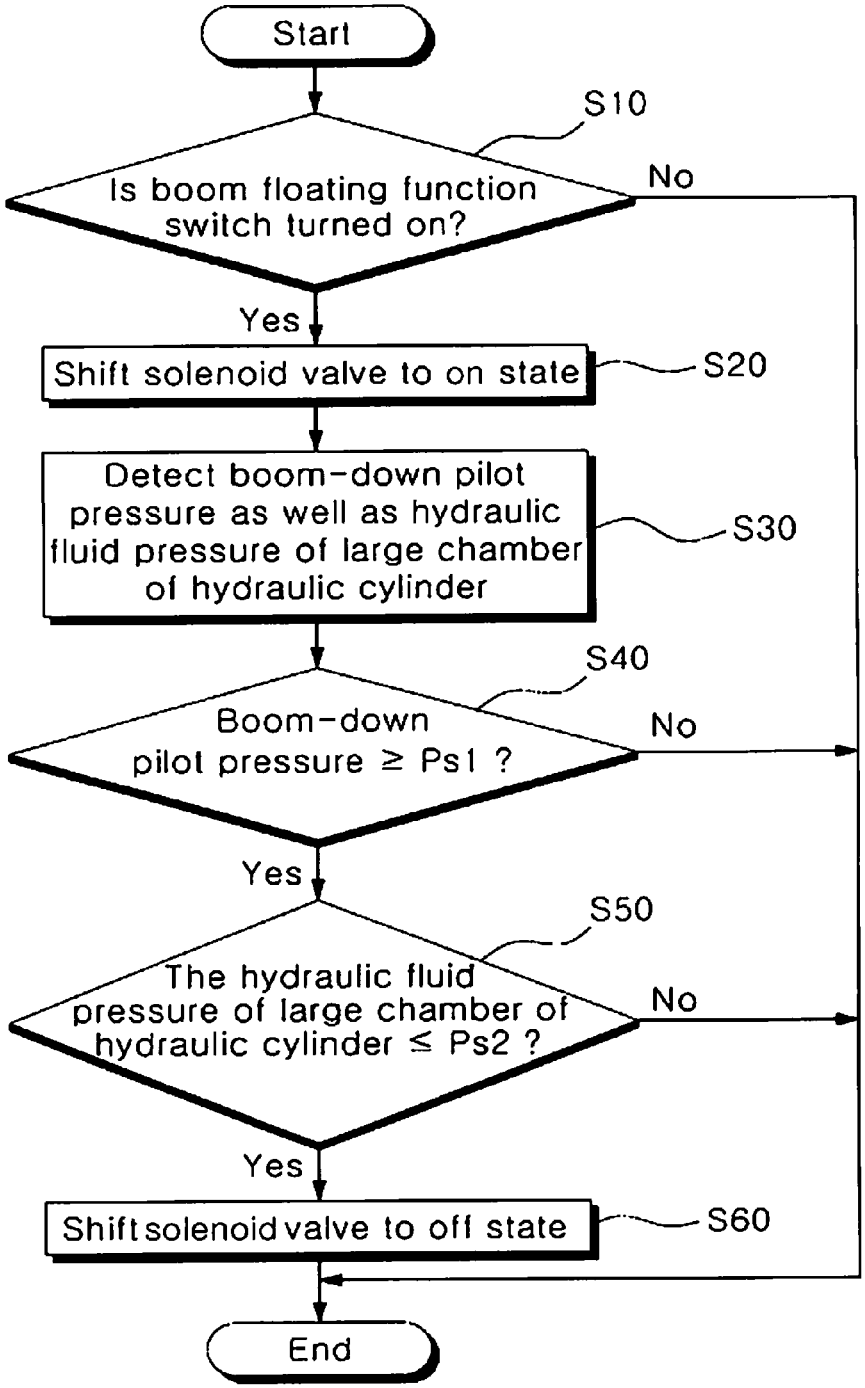
FIG. 3 is a flow chart showing a control algorithm of a control valve in a hydraulic circuit for a construction machine having a floating function in accordance with an embodiment of the present invention.
Figure 4:
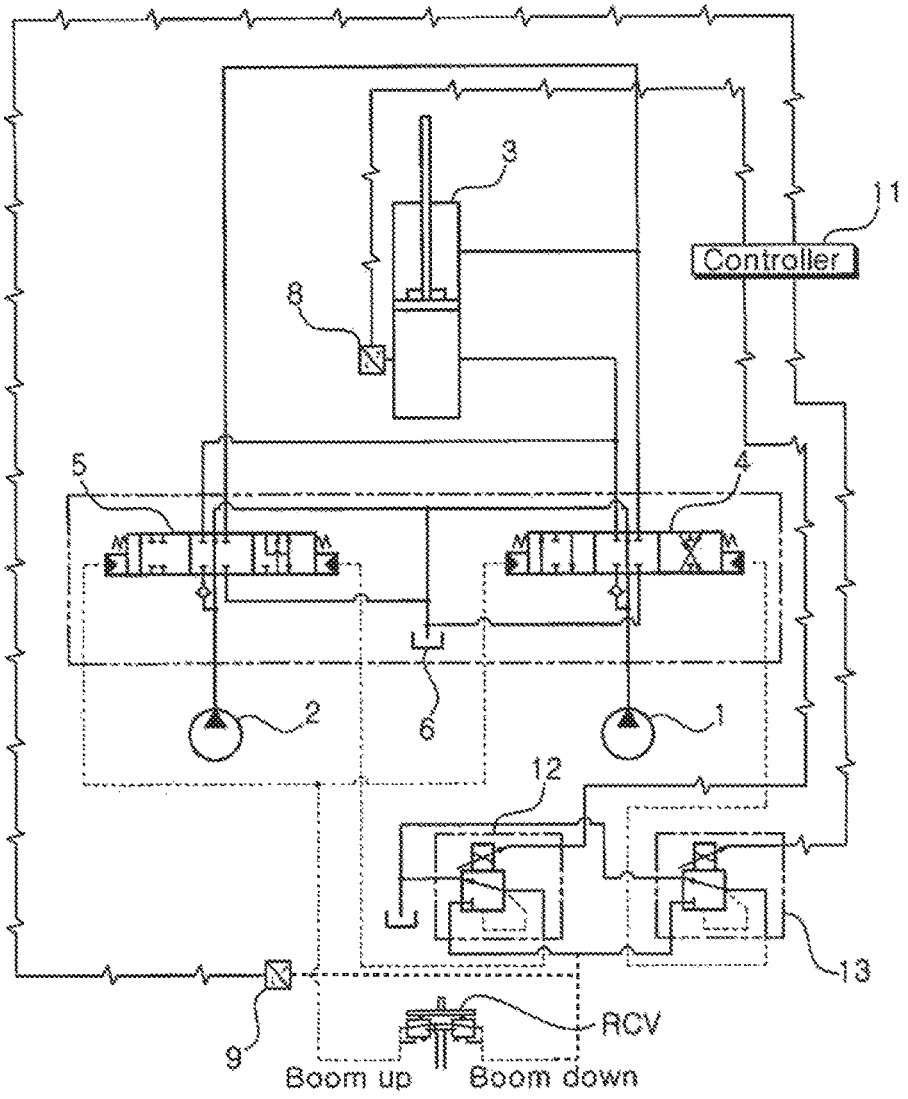
FIG. 4 is a diagram showing a hydraulic circuit for a construction machine having a floating function in accordance with another embodiment of the present invention.
Figure 5:
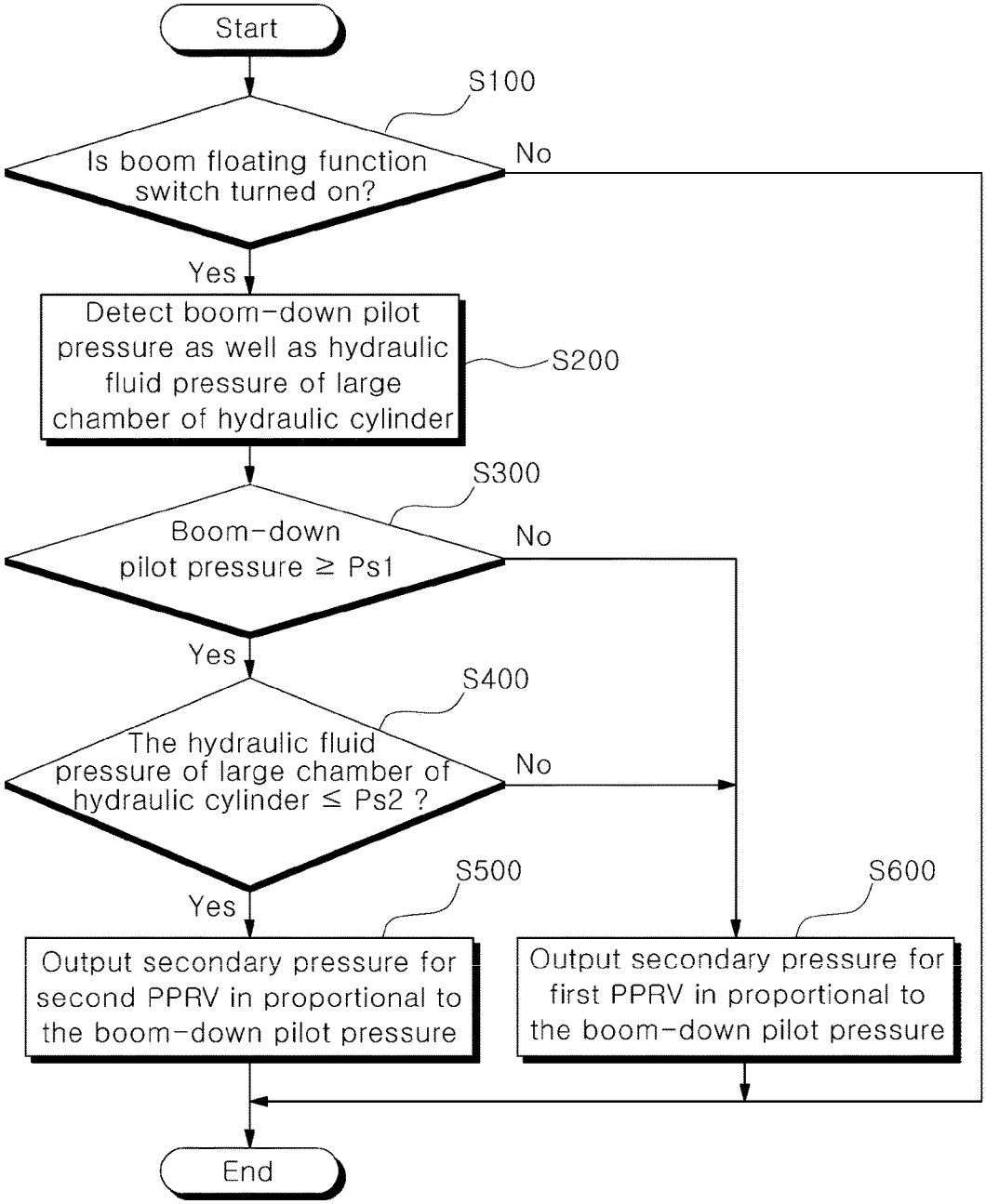
FIG. 5 is a flow chart showing a control algorithm of a control valve in a hydraulic circuit for a construction machine having a floating function in accordance with another embodiment of the present invention.

FIG. 2 is a diagram showing a hydraulic circuit for a construction machine having a floating function in accordance with an embodiment of the present invention, FIG. 3 is a flow chart showing a control algorithm of a control valve in a hydraulic circuit for a construction machine having a floating function in accordance with an embodiment of the present invention, FIG. 4 is a diagram showing a hydraulic circuit for a construction machine having a floating function in accordance with another embodiment of the present invention, and FIG. 5 is a flow chart showing a control algorithm of a control valve in a hydraulic circuit for a construction machine having a floating function in accordance with another embodiment of the present invention.

Referring to FIGS. 2 and 3, a hydraulic circuit for a construction machine having a floating function in accordance with an embodiment of the present invention includes:

at least two hydraulic pumps 1 and 2;

a hydraulic cylinder 3 that is driven by hydraulic fluids supplied from the hydraulic pumps 1 and 2;

a boom driving control valve 4 that is installed in a flow path between any one 1 of the hydraulic pumps 1 and 2 and the hydraulic cylinder 3 and is configured to be shifted to control a start, a stop, and a direction change of the hydraulic cylinder 3;

a boom confluence control valve 5 that is installed in a flow path between the other 2 of the hydraulic pumps 1 and 2 and the hydraulic cylinder 3 and is configured to be shifted to allow the hydraulic fluids discharged from the hydraulic pumps 1 and 2 to join together so as to be supplied to a large chamber of the hydraulic cylinder 3 or to allow hydraulic fluids of the large chamber and a small chamber of the hydraulic cylinder 3 to join together so as to be supplied to a hydraulic tank 6;

a manipulation lever (RCV) that is configured to output a manipulation signal corresponding to a manipulation amount;

a first pressure sensor 8 that is configured to detect a pressure of the hydraulic fluid on the large chamber of the hydraulic cylinder 3;

a second pressure sensor 9 that is configured to detect a boom-down pilot pressure that is applied to the other end of the boom driving control valve 4; and a control valve 7 that is installed in a flow path between the manipulation lever and the boom driving control valve 4 and the boom confluence control valve 5, and is configured to be shifted in response to the application of electrical signals that correspond to the pressure values detected by the first and second pressure sensors 8 and 9 to shift the boom confluence control valve 5 to a floating state through application of the boom-down pilot pressure to the boom confluence control valve 5, or to supply the hydraulic fluid of the one 1 of the hydraulic pumps 1 and 2 to the small chamber of the hydraulic cylinder 3 by the shift of the boom driving control valve 4 through application of the boom-down pilot pressure to the boom driving control valve 4.

The control valve 7 is a solenoid valve configured to be shifted to an initial state where the hydraulic fluid of the one 1 of the hydraulic pumps 1 and 2 is supplied to the small chamber of the hydraulic cylinder 3 through the application of the boom-down pilot pressure to the boom driving control valve 4, or to an ON state where the boom confluence control valve 5 is shifted to the floating state through the application of the boom-down pilot pressure to the boom confluence control valve 5.

The control valve 7 is shifted to an off state if the boom-down pilot pressure is higher than or equal to a predetermined pressure based on a detection signal of the second pressure sensor 9, and the hydraulic fluid pressure of the large chamber of the hydraulic cylinder 3 is lower than or equal to a predetermined pressure based on a detection signal of the first pressure sensor 8.

Referring to FIGS. 2 and 3, in accordance with an embodiment of the present invention, in a method for controlling a floating function for a construction machine including at least two hydraulic pumps 1 and 2, a hydraulic cylinder 3 driven by hydraulic fluids supplied from the hydraulic pumps 1 and 2, a boom driving control valve 4 installed in a flow path between any one 1 of the hydraulic pumps 1 and 2 and the hydraulic cylinder 3, a boom confluence control valve 5 installed in a flow path between the other 2 of the hydraulic pumps 1 and 2 and the hydraulic cylinder 3, a manipulation lever (RCV), a first pressure sensor 8 configured to measure a pressure of the hydraulic fluid on a large chamber of the hydraulic cylinder 3, a second pressure sensor 9 configured to measure a boom-down pilot pressure that is applied to the other end of the boom driving control valve 4, and a control valve 7 installed in a flow path between the manipulation lever, and the boom driving control valve 4 and the boom confluence control valve 5, the method includes:

a step S10 of determining whether a boom floating function switch (not shown) is operated to be turned on;

a step S20 of, if the boom floating function switch is operated to be turned on, shifting the control valve 7 to an on state in response to the application of an electrical signal to the control valve 7 to cause the boom confluence control valve to be shifted to a floating state through application of the boom-down pilot pressure to the boom confluence control valve 5;

a step S30 of measuring the hydraulic fluid pressure of the large chamber of the hydraulic cylinder 3 through the first pressure sensor 8, and measuring the boom-down pilot pressure that is applied to the other end of the boom driving control valve 4 through the second pressure sensor 9;

a step S40 of determining whether the boom-down pilot pressure is higher than or equal to a predetermined pressure based on a detection signal of the second pressure sensor 9;

a step S50 of determining whether the hydraulic fluid pressure of the large chamber of the hydraulic cylinder 3 is lower than or equal to a predetermined pressure based on a detection signal of the first pressure sensor 8; and a step S60 of shifting the control valve 7 to an off state if the boom-down pilot pressure is higher than or equal to the predetermined pressure based on a detection signal of the second pressure sensor 9, and the hydraulic fluid pressure of the large chamber of the hydraulic cylinder 3 is lower than or equal to the predetermined pressure based on a detection signal of the first pressure sensor 8.

A non-explained reference numeral 11 denotes a controller that receives an input of a detection signal from the first and second pressure sensors 8 and 9, and applies an electrical signal to the control valve 7 to shift the control valve 7.

By virtue of the configuration as described above, the boom-down operation in which a boom descends in a floating state to perform the leveling and grading work using an excavator will be described hereinafter with reference to FIGS. 2 and 3.

A spool of the control valve 7 is shifted to the left on the drawing sheet in response to an electrical signal applied thereto from the controller 11 to cause a boom-down pilot pressure to be applied to a right end of the boom confluence control valve 5 via the control valve 7. Resultantly, the hydraulic fluids from the hydraulic pumps 1 and 2 join together so as to be returned to the hydraulic fluid tank 6, and the hydraulic fluids of the small chamber and the larger chamber of the hydraulic cylinder 3 join together at an internal passage 5*c* of the boom confluence control valve 5 so as to be returned to the hydraulic fluid tank 6.

Thus, in the case where the leveling and grading work is performed by using an excavator, the boom confluence control valve 5 is shifted to the floating state so that the leveling and grading work can be performed while the boom descending by the work apparatus's own weight to avoid the use of the hydraulic fluids from the hydraulic pumps 1 and 2. As a result, the hydraulic fluids from the hydraulic pumps 1 and 2 are supplied to another hydraulic actuator (e.g., a swing motor or the like) except the hydraulic cylinder 3 (e.g., a boom cylinder) so that the hydraulic energy can be saved.

In the meantime, the operation in which the hydraulic fluids from the hydraulic pumps 1 and 2 join together so as to be supplied the large chamber of the hydraulic cylinder 3 will be described hereinafter with reference with FIG. 2.

A boom-up pilot pressure is applied to left ends of the boom confluence control valve 5 and the boom driving control valve 4 by the manipulation of the manipulation lever to shift the spools of the boom confluence control valve 5 and the boom driving control valve 4 to the right. Resultantly, the hydraulic fluid from the hydraulic pump 1 is supplied to the large chamber of the hydraulic cylinder 3 via the shifted boom driving control valve 4, and the hydraulic fluid from the hydraulic pump 2 is supplied to the large chamber of the hydraulic cylinder 3 via the shifted confluence driving control valve 5.

In other words, the hydraulic fluid from the hydraulic pump 2 joins the hydraulic fluid from the hydraulic pump 1, which has passed through the boom driving control valve 4, and is supplied to the larger chamber of the hydraulic cylinder 3 so that the boom-up operation can be performed.

In the meantime, the operation in which the boom descends to perform a general work using the excavator will be described hereinafter with reference with FIG. 2.

The boom-down pilot pressure is applied to a right end of the boom driving control valve 4 via the control valve 7 by the manipulation of the manipulation lever to shift the spool of the boom driving control valve 4 to the left. Resultantly, the hydraulic fluid from the hydraulic pump 1 is supplied to the small chamber of the hydraulic cylinder 3 via the shifted boom driving control valve 4, and the hydraulic fluid discharged from the large chamber of the hydraulic cylinder 3 is returned to the hydraulic fluid tank 6 via the shifted boom driving control valve 4.

Thus, the hydraulic cylinder 3 can be driven in a stretchable manner to perform the boom-down operation.

In the meantime, the operation in which the boom descends in a state where the boom confluence control valve 5 is shifted to the floating mode with reference with FIGS. 2 and 3.

In step S10, the controller 11 determines whether a boom floating function switch (not shown) is operated to be turned on. If it is determined that boom floating function switch is operated to be turned on, the program proceeds to step S20, and it is determined that boom floating function switch is operated to be turned off, the program is terminated.

In step S20, if the control valve 7 is shifted to an on state in response to the application of an electrical signal thereto from the controller 11, the boom-down pilot pressure is applied to the boom confluence control valve 5 to cause the boom confluence control valve 5 to be shifted to the floating state.

In step S30, the hydraulic fluid pressure of the large chamber of the hydraulic cylinder 3 is measured by the first pressure sensor 8 and the boom-down pilot pressure applied to the boom driving control valve 4 is measured by the second pressure sensor 9, and the detection signals of the first and second pressure sensors 8 and 9 are applied to the controller 11.

In step S40, the boom-down pilot pressure detected by the second pressure sensor 9 is compared with a predetermined pressure Ps1. If it is determined that the detected boom-down pilot pressure is higher than or equal to the predetermined pressure Ps1, the program proceeds to step S50, and if it is determined that the boom-down pilot pressure is lower than the predetermined pressure Ps1, the program is terminated.

In step S50, the hydraulic fluid pressure of the large chamber of the hydraulic cylinder 3, which is detected by the first pressure sensor 8, is compared with a predetermined pressure Ps2. If it is determined that the detected hydraulic fluid pressure of the large chamber of the hydraulic cylinder 3 is lower than or equal to the predetermined pressure Ps2, the program proceeds to step S60, and if it is determined that the detected hydraulic fluid pressure of the large chamber of the hydraulic cylinder 3 is higher than the predetermined pressure Ps2, the program is terminated.

In step S60, if it is determined that the boom-down pilot pressure detected by the second pressure sensor 9 is higher than or equal to the predetermined pressure Ps1 and the hydraulic fluid pressure of the large chamber of the hydraulic cylinder 3, which is detected by the first pressure sensor 8 is lower than or equal to the predetermined pressure Ps2, the control valve 7 is shifted to the off state in response to an electrical signal applied thereto from the controller 11.

As described above, in a state where the control valve 7 is shifted to the on state in response to the electrical signal applied thereto from the controller 11 to cause the boom confluence control valve 5 to be shifted to the floating state, if the boom-down pilot pressure detected by the second pressure sensor 9 is higher than or equal to the predetermined pressure Ps1 (i.e., boom-down pilot pressure≥Ps1) and the hydraulic fluid pressure of the large chamber of the hydraulic cylinder 3, which is detected by the first pressure sensor 8 is lower than or equal to the predetermined pressure Ps2 (i.e., hydraulic fluid pressure of the large chamber of the hydraulic cylinder 3≤Ps2), the control valve 7 is shifted to the off state in response to an electrical signal applied thereto from the controller 11 (see FIG. 2).

Thus, the boom-down pilot pressure is applied to the right end of the boom driving control valve 4 via the control valve 7 by the manipulation of the manipulation lever to shift the spool of the boom driving control valve 4 to the left on the drawing sheet. Resultantly, the hydraulic fluid from the hydraulic pump 1 is supplied to the small chamber of the hydraulic cylinder 3 via the shifted boom driving control valve 4, and the hydraulic fluid discharged from the large chamber of the hydraulic cylinder 3 is returned to the hydraulic fluid tank 6 via the shifted boom driving control valve 4.

Accordingly, during the leveling and grading work using the excavator, if the boom-down pilot pressure detected by the second pressure sensor 9 is higher than or equal to the predetermined pressure and the hydraulic fluid pressure of the large chamber of the hydraulic cylinder 3, which is detected by the first pressure sensor 8 is lower than or equal to the predetermined pressure, the control valve 7 is shifted to the off state in response to an electrical signal applied thereto from the controller 11. As a result, the boom-down pilot pressure is applied to the boom driving control valve 4 to cause the hydraulic fluid from the hydraulic pump 1 to be supplied to the small chamber of the hydraulic cylinder 3 so that the boom can descend to perform the jack-up operation.

Referring to FIGS. 4 and 5, a hydraulic circuit for a construction machine having a floating function in accordance with another embodiment of the present invention includes:

at least two hydraulic pumps 1 and 2;

a hydraulic cylinder 3 that is driven by hydraulic fluids supplied from the hydraulic pumps 1 and 2;

a boom driving control valve 4 that is installed in a flow path between any one 1 of the hydraulic pumps 1 and 2 and the hydraulic cylinder 3 and is configured to be shifted to control a start, a stop, and a direction change of the hydraulic cylinder 3;

a boom confluence control valve 5 that is installed in a flow path between the other 2 of the hydraulic pumps 1 and 2 and the hydraulic cylinder 3 and is configured to be shifted to allow the hydraulic fluids discharged from the hydraulic pumps 1 and 2 to join together so as to be supplied to a large chamber of the hydraulic cylinder 3 or to allow hydraulic fluids of the large chamber and a small chamber of the hydraulic cylinder 3 to join together so as to be supplied to a hydraulic tank 6;

a manipulation lever (not shown) that is configured to output a manipulation signal corresponding to a manipulation amount;

a first pressure sensor 8 that is configured to detect a pressure of the hydraulic fluid on the large chamber of the hydraulic cylinder 3;

a second pressure sensor 9 that is configured to detect a boom-down pilot pressure that is applied to the other end of the boom driving control valve 4;

a first electronic proportional control valve 12 that is installed in a flow path between the manipulation lever and the boom confluence control valve 5 and is configured to shift the boom confluence control valve 5 to a floating mode by generating the boom-down pilot pressure in proportion to an electrical signal applied thereto and applying the generated boom-down pilot pressure to the boom confluence control valve 5;

a second electronic proportional control valve 13 that is installed in a flow path between the manipulation lever and the boom driving control valve 4 and is configured to supply the hydraulic fluid of the one 1 of the hydraulic pumps 1 and 2 to the small chamber of the hydraulic cylinder 3 by generating the boom-down pilot pressure in proportion to the electrical signal applied thereto and applying the generated boom-down pilot pressure to the boom driving control valve 4; and a controller 11 that is configured to receive an input of the pressure values detected by the first and second pressure sensors 8 and 9, calculate the electrical signal corresponding to the pressure value detected by the second pressure sensor 9, and apply the calculated electrical signal to the first and second electronic proportional control valves 12 and 13.

Referring to FIGS. 4 and 5, in accordance with another embodiment of the present invention, in a method for controlling a floating function for a construction machine including at least two hydraulic pumps 1 and 2, a hydraulic cylinder 3 driven by hydraulic fluids supplied from the hydraulic pumps 1 and 2, a boom driving control valve 4 installed in a flow path between any one 1 of the hydraulic pumps 1 and 2 and the hydraulic cylinder 3, a boom confluence control valve 5 installed in a flow path between the other 2 of the hydraulic pumps 1 and 2 and the hydraulic cylinder 3, a manipulation lever (not shown), a first pressure sensor 8 configured to measure a pressure of the hydraulic fluid on a large chamber of the hydraulic cylinder 3, a second pressure sensor 9 configured to measure a boom-down pilot pressure that is applied to the other end of the boom driving control valve 4, a first electronic proportional control valve 12 installed in a flow path between the manipulation lever and the boom confluence control valve 5; and a second electronic proportional control valve 13 installed in a flow path between the manipulation lever and the boom driving control valve 4, the method includes:

a step (S100) of determining whether a boom floating function switch is operated to be turned on;

a step (S200) of measuring the hydraulic fluid pressure of the large chamber of the hydraulic cylinder 3 through the first pressure sensor 8, and measuring the boom-down pilot pressure that is applied to the boom driving control valve 4 through the second pressure sensor 9;

a step (S300) of determining whether the boom-down pilot pressure is higher than or equal to a predetermined pressure Ps1 based on a detection signal of the second pressure sensor 9;

a step (S400) of determining whether the hydraulic fluid pressure of the large chamber of the hydraulic cylinder 3 is lower than a predetermined pressure Ps2 based on a detection signal of the first pressure sensor 8;

a step (S500) of supplying the hydraulic fluid of the one 1 of the hydraulic pumps 1 and 2 to a small chamber of the hydraulic cylinder 3 by applying the boom-down pilot pressure, which is generated in proportion to an electrical signal corresponding to a pressure detection value of the second pressure sensor 9, to the boom driving control valve 4 if the boom-down pilot pressure is higher than or equal to the predetermined pressure Ps1 (i.e., the boom-down pilot pressure≥Ps1) based on a detection signal of the second pressure sensor 9, and the hydraulic fluid pressure of the large chamber of the hydraulic cylinder 3 is lower than or equal to the predetermined pressure Ps2 (i.e., the hydraulic fluid pressure of the large chamber≤Ps2) based on a detection signal of the first pressure sensor 8; and a step (S600) of shifting the boom confluence control valve 5 to a floating mode by applying the boom-down pilot pressure, which is generated in proportion to the electrical signal corresponding to the pressure detection value of the second pressure sensor 9, to the boom confluence control valve 5 if the boom-down pilot pressure is lower than the predetermined pressure Ps1 based on the detection signal of the second pressure sensor 9, and the hydraulic fluid pressure of the large chamber of the hydraulic cylinder 3 is higher than the predetermined pressure Ps2 based on the detection signal of the first pressure sensor 8.

In this case, a configuration of the hydraulic circuit for a construction machine having a floating function in accordance with another embodiment of the present invention is the same as that of the hydraulic circuit for a construction machine having a floating function in accordance with an embodiment of the present invention, except the first electronic proportional control valve 12 installed in a flow path between the manipulation lever and the boom confluence control valve 5, the second electronic proportional control valve 13 installed in a flow path between the manipulation lever and the boom driving control valve 4, and the controller configured to receive an input of the pressure values detected by the first and second pressure sensors 8 and 9, calculate the electrical signal corresponding to the pressure value detected by the second pressure sensor 9, and apply the calculated electrical signal to the first and second electronic proportional control valves 12 and 13. Thus, the detailed description of the same configuration and operation thereof will be omitted to avoid redundancy, and the same hydraulic parts are denoted by the same reference numerals.

By virtue of the configuration as described above, the boom-down operation in which a boom descends in a floating state to perform the leveling and grading work using an excavator will be described hereinafter with reference to FIGS. 2 and 3.

In step S100, the controller 11 determines whether a boom floating function switch is operated to be turned on. If it is determined that boom floating function switch is operated to be turned on, the program proceeds to step S200, and it is determined that boom floating function switch is operated to be turned off, the program is terminated.

In step S200, the hydraulic fluid pressure of the large chamber of the hydraulic cylinder 3 is measured by the first pressure sensor 8 and the boom-down pilot pressure applied to the boom driving control valve 4 is measured by the second pressure sensor 9. In this case, the detection signals measured by the first and second pressure sensors 8 and 9 are applied to the controller 11.

In step S300, the boom-down pilot pressure detected by the second pressure sensor 9 is compared with a predetermined pressure Ps1. If it is determined that the detected boom-down pilot pressure is higher than or equal to the predetermined pressure Ps1, the program proceeds to step S400, and if it is determined that the boom-down pilot pressure is lower than the predetermined pressure Ps1, the program proceeds to step S600.

In step S400, the hydraulic fluid pressure of the large chamber of the hydraulic cylinder 3, which is detected by the first pressure sensor 8, is compared with a predetermined pressure Ps2. If it is determined that the detected hydraulic fluid pressure of the large chamber of the hydraulic cylinder 3 is lower than or equal to the predetermined pressure Ps2, the program proceeds to step S500, and if it is determined that the detected hydraulic fluid pressure of the large chamber of the hydraulic cylinder 3 is higher than the predetermined pressure Ps2, the program proceeds to step S600.

In step S500, if it is determined that the boom-down pilot pressure detected by the second pressure sensor 9 is higher than or equal to the predetermined pressure Ps1 and the hydraulic fluid pressure of the large chamber of the hydraulic cylinder 3, which is detected by the first pressure sensor 8 is lower than or equal to the predetermined pressure Ps2, the controller 11 applies an electrical signal calculated in proportion to the boom-down pilot pressure measured by the second pressure sensor 9 to the second electronic proportional control valve 13.

The second electronic proportional control valve 13 generates a pilot pressure corresponding to the electrical signal applied thereto and applies the generated pilot pressure to the right end of the boom driving control valve 4. Thus, the spool of the boom driving control valve 4 is shifted to the left on the drawing sheet. Resultantly, the hydraulic fluid discharged from the hydraulic pump 1 is supplied to the small chamber of the hydraulic cylinder 3 via the shifted boom driving control valve 4, and the hydraulic fluid discharged from the large chamber of the hydraulic cylinder 3 is returned to the hydraulic fluid tank 6 via the shifted boom driving control valve 4. Thus, the hydraulic cylinder 3 can be driven in a stretchable manner to descend the boom.

In other words, during the leveling and grading work using the excavator, if the boom-down pilot pressure detected by the second pressure sensor 9 is higher than or equal to the predetermined pressure and the hydraulic fluid pressure of the large chamber of the hydraulic cylinder 3, which is detected by the first pressure sensor 8 is lower than or equal to the predetermined pressure, the boom driving control valve 4 is shifted to cause the hydraulic fluid from the hydraulic pump 1 to be supplied to the small chamber of the hydraulic cylinder 3 so that the boom can descend to perform the jack-up operation.

In step S600, if it is determined that the boom-down pilot pressure is lower than the predetermined pressure Ps1 based on the detection signal of the second pressure sensor 9 and the hydraulic fluid pressure of the large chamber of the hydraulic cylinder 3 is higher than the predetermined pressure Ps2 based on the detection signal of the first pressure sensor 8, the controller 11 applies an electrical signal calculated in proportion to the boom-down pilot pressure measured by the second pressure sensor 9 to the first electronic proportional control valve 12.

The first electronic proportional control valve 12 generating the boom-down pilot pressure in proportion to the electrical signal applied thereto and applying the generated boom-down pilot pressure to the right end of the boom confluence control valve 5. In other words, the spool of the boom confluence control valve 5 is shifted to the right on the drawing sheet to cause the hydraulic fluids of the large chamber and the small chamber of the hydraulic cylinder 3 to join together so as to be supplied to the hydraulic fluid tank 6 so that the boom confluence control valve 5 can be shifted to the floating mode. In this case, the hydraulic fluid discharged from the hydraulic pump 2 is returned to the hydraulic fluid tank 6 via the boom confluence control valve 5.

INDUSTRIAL APPLICABILITY

In accordance with the hydraulic circuit for a construction machine having a floating function and the method for controlling the floating function of the present invention as constructed above, in the case where the leveling and grading work is performed by using an excavator or the boom descends by its own weight, the hydraulic fluid discharged from the hydraulic pump is supplied to a hydraulic actuator other than a boom cylinder, thereby saving the hydraulic energy. In addition, in the floating mode, the hydraulic fluid discharged from the hydraulic pump is selectively supplied to a small chamber of the boom cylinder to perform the jack-up operation, thereby providing convenience to an operator and improving the workability.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

The invention claimed is:

1. A hydraulic circuit for a construction machine having a floating function, comprising:

at least two hydraulic pumps;

a hydraulic cylinder driven by hydraulic fluids supplied from the hydraulic pumps;

a boom driving control valve installed in a flow path between any one of the hydraulic pumps and the hydraulic cylinder and configured to be shifted to control a start, a stop, and a direction change of the hydraulic cylinder;

a boom confluence control valve installed in a flow path between another of the hydraulic pumps and the hydraulic cylinder and configured to be shifted to allow the hydraulic fluids discharged from the hydraulic pumps to join together so as to be supplied to a large chamber of the hydraulic cylinder or to allow hydraulic fluids of the large chamber and a small chamber of the hydraulic cylinder to join together so as to be supplied to a hydraulic tank;

a manipulation lever (RCV) configured to output a manipulation signal corresponding to a manipulation amount;

a first pressure sensor configured to measure a pressure of the hydraulic fluid on the large chamber of the hydraulic cylinder;

a second pressure sensor configured to measure a boom-down pilot pressure that is applied to an end of the boom driving control valve; and a control valve installed in a flow path between the manipulation lever and the boom driving control valve, and installed in another flow path between the manipulation lever and the boom confluence control valve, and configured to be shifted in response to the application of electrical signals that correspond to the pressure and the boom-down pilot pressure detected by the first and second pressure sensors to shift the boom confluence control valve to a floating state through application of the boom-down pilot pressure to the boom confluence control valve, or to supply the hydraulic fluid of the one of the hydraulic pumps to the small chamber of the hydraulic cylinder by the shift of the boom driving control valve through application of the boom-down pilot pressure to the boom driving control valve.

2. The hydraulic circuit according to claim 1, wherein the control valve is a solenoid valve configured to be shifted to an initial state where the hydraulic fluid of the one of the hydraulic pumps is supplied to the small chamber of the hydraulic cylinder through the application of the boom-down pilot pressure to the boom driving control valve, or to an on state where the boom confluence control valve is shifted to the floating state through the application of the boom-down pilot pressure to the boom confluence control valve.

3. The hydraulic circuit according to claim 1, wherein the control valve is shifted to an off state if the boom-down pilot pressure is higher than or equal to a predetermined pressure based on a detection signal of the second pressure sensor, and the hydraulic fluid pressure of the large chamber of the hydraulic cylinder is lower than or equal to another predetermined pressure based on a detection signal of the first pressure sensor.

4. A method for controlling a floating function for a construction machine including at least two hydraulic pumps, a hydraulic cylinder driven by hydraulic fluids supplied from the hydraulic pumps, a boom driving control valve installed in a flow path between any one of the hydraulic pumps and the hydraulic cylinder, a boom confluence control valve installed in a flow path between another of the hydraulic pumps and the hydraulic cylinder, a manipulation lever (RCV), a first pressure sensor configured to measure a pressure of the hydraulic fluid on a large chamber of the hydraulic cylinder, a second pressure sensor configured to measure a boom-down pilot pressure that is applied to an end of the boom driving control valve, and a control valve installed in a flow path between the manipulation lever and the boom driving control valve, and installed in another flow path between the manipulation lever the boom confluence control valve, the method comprising:

a step of determining whether a boom floating function switch is operated to be turned on;

a step of, if the boom floating function switch is operated to be turned on, shifting the control valve to an on state in response to the application of an electrical signal to the control valve to cause the boom confluence control valve to be shifted to a floating state through application of the boom-down pilot pressure to the boom confluence control valve;

a step of measuring the hydraulic fluid pressure of the large chamber of the hydraulic cylinder through the first pressure sensor, and measuring the boom-down pilot pressure that is applied to the end of the boom driving control valve through the second pressure sensor; and a step of shifting the control valve to an off state if the boom-down pilot pressure is higher than or equal to a predetermined pressure based on a detection signal of the second pressure sensor, and the hydraulic fluid pressure of the large chamber of the hydraulic cylinder is lower than or equal to another predetermined pressure based on a detection signal of the first pressure sensor.

5. A hydraulic circuit for a construction machine having a floating function, comprising:

at least two hydraulic pumps;

a hydraulic cylinder driven by hydraulic fluids supplied from the hydraulic pumps;

a boom driving control valve installed in a flow path between any one of the hydraulic pumps and the hydraulic cylinder and configured to be shifted to control a start, a stop, and a direction change of the hydraulic cylinder;

a boom confluence control valve installed in a flow path between another of the hydraulic pumps and the hydraulic cylinder and configured to be shifted to allow the hydraulic fluids discharged from the hydraulic pumps to join together so as to be supplied to a large chamber of the hydraulic cylinder or to allow hydraulic fluids of the large chamber and a small chamber of the hydraulic cylinder to join together so as to be supplied to a hydraulic tank;

a manipulation lever (RCV) configured to output a manipulation signal corresponding to a manipulation amount;

a first pressure sensor configured to measure a pressure of the hydraulic fluid on the large chamber of the hydraulic cylinder;

a second pressure sensor configured to measure a boom-down pilot pressure that is applied to an end of the boom driving control valve;

a first electronic proportional control valve installed in a flow path between the manipulation lever and the boom confluence control valve and configured to shift the boom confluence control valve to a floating mode by generating the boom-down pilot pressure in proportion to an electrical signal applied thereto and applying the generated boom-down pilot pressure to the boom confluence control valve;

a second electronic proportional control valve installed in a flow path between the manipulation lever and the boom driving control valve and configured to supply the hydraulic fluid of the one of the hydraulic pumps to the small chamber of the hydraulic cylinder by generating the boom-down pilot pressure in proportion to the electrical signal applied thereto and applying the generated boom-down pilot pressure to the boom driving control valve; and a controller configured to receive an input of the pressure values detected by the first and second pressure sensors, calculate the electrical signal corresponding to the pressure value detected by the second pressure sensor, and apply the calculated electrical signal to the first and second electronic proportional control valves.

6. A method for controlling a floating function for a construction machine including at least two hydraulic pumps, a hydraulic cylinder driven by hydraulic fluids supplied from the hydraulic pumps, a boom driving control valve installed in a flow path between any one of the hydraulic pumps and the hydraulic cylinder, a boom confluence control valve installed in a flow path between another of the hydraulic pumps and the hydraulic cylinder, a manipulation lever (RCV), a first pressure sensor configured to measure a pressure of the hydraulic fluid on a large chamber of the hydraulic cylinder, a second pressure sensor configured to measure a boom-down pilot pressure that is applied to the boom driving control valve, a first electronic proportional control valve installed in a flow path between the manipulation lever and the boom confluence control valve, and a second electronic proportional control valve installed in a flow path between the manipulation lever and the boom driving control valve, the method comprising:

a step of determining whether a boom floating function switch is operated to be turned on;

a step of measuring the hydraulic fluid pressure of the large chamber of the hydraulic cylinder through the first pressure sensor, and measuring the boom-down pilot pressure that is applied to the boom driving control valve through the second pressure sensor;

a step of supplying the hydraulic fluid of the one of the hydraulic pumps to a small chamber of the hydraulic cylinder by applying the boom-down pilot pressure, which is generated in proportion to an electrical signal corresponding to a pressure detection value of the second pressure sensor, to the boom driving control valve if the boom-down pilot pressure is higher than or equal to another predetermined pressure based on a detection signal of the second pressure sensor, and the hydraulic fluid pressure of the large chamber of the hydraulic cylinder is lower than or equal to a predetermined pressure based on a detection signal of the first pressure sensor; and a step of shifting the boom confluence control valve to a floating mode by applying the boom-down pilot pressure, which is generated in proportion to the electrical signal corresponding to the pressure detection value of the second pressure sensor, to the boom confluence control valve if the boom-down pilot pressure is lower than the predetermined pressure based on the detection signal of the second pressure sensor, and the hydraulic fluid pressure of the large chamber of the hydraulic cylinder is higher than the other predetermined pressure based on the detection signal of the first pressure sensor.

* * * * *